US008713790B2

(12) United States Patent
Watson et al.

(10) Patent No.: US 8,713,790 B2
(45) Date of Patent: May 6, 2014

(54) SYSTEM AND METHOD FOR INSTALLING SHOWER WALLS

(75) Inventors: Brian John Watson, London (GB); Philip Mark Hall, London (GB); Anthony Arthur Wills, London (GB); Steve George, Tigard, OR (US)

(73) Assignee: Vertex Stone and Chinaware Ltd., Hong Kong (CN)

( * ) Notice: Subject to any disclaimer, the term of this patent is extended or adjusted under 35 U.S.C. 154(b) by 355 days.

(21) Appl. No.: 12/868,352

(22) Filed: Aug. 25, 2010

(65) Prior Publication Data

US 2012/0047721 A1 Mar. 1, 2012

(51) Int. Cl.
*B23P 19/00* (2006.01)

(52) U.S. Cl.
USPC ..... 29/700; 29/281.1; 29/281.5; 269/32; 269/229; 269/291; 269/305; 269/37; 269/41; 269/236; 248/354.1

(58) Field of Classification Search
USPC ..... 29/700, 281.5, 281, 462, 428, 819; 269/231, 236, 904, 229, 295, 32, 294, 269/305, 291, 41, 235, 138, 196–200, 234; 52/127.1, 127.2, 127.11, 127.8, 645, 52/633; 248/354.1; 24/68 SK, 68 E
See application file for complete search history.

(56) References Cited

U.S. PATENT DOCUMENTS 651,924 A * 6/1900 Johnson ..... 254/204
716,904 A * 12/1902 Lawson ..... 254/209
2,630,076 A * 3/1953 Stieve ..... 104/126
2,794,217 A 6/1957 Croft
3,327,983 A 6/1967 Snapp
3,689,018 A * 9/1972 Pelle et al. ..... 249/13
3,752,440 A * 8/1973 Ream ..... 254/209
3,861,634 A * 1/1975 Hood et al. ..... 248/228.3
4,017,052 A * 4/1977 Azzaroni ..... 249/183
4,747,180 A * 5/1988 Screen ..... 16/35 R
4,772,058 A * 9/1988 Andersen ..... 294/8.6
5,114,127 A 5/1992 Everhart
5,152,085 A * 10/1992 Baggio et al. ..... 36/118.7
5,169,258 A * 12/1992 Raynak ..... 403/170
5,222,420 A 6/1993 Sorensen et al.
5,263,260 A 11/1993 Smith
5,263,507 A * 11/1993 Chuang ..... 135/140
5,377,462 A 1/1995 Beals et al.
5,421,666 A * 6/1995 Spears ..... 403/176
5,678,331 A * 10/1997 Bonaventure ..... 36/117.1
5,829,096 A * 11/1998 Perry ..... 16/35 R
6,371,422 B1 4/2002 St. Martin et al.
6,508,448 B1 1/2003 Stewart
6,591,574 B2 7/2003 Humphrey
6,976,339 B1 * 12/2005 Riccio et al. ..... 52/127.1

(Continued)

*Primary Examiner* — Joseph J Hail
*Assistant Examiner* — Henry Hong
(74) *Attorney, Agent, or Firm* — Rodman & Rodman

(57) ABSTRACT

The system for installing shower walls includes a pressure transfer member for urging a shower wall against a back up support during bonding of the shower wall to the support. An adjustable force development device engages the pressure transfer member to force the pressure transfer member against the shower wall. A support member engages the pressure transfer member when the force development device exerts a predetermined force against the shower wall. A fixation device holds the support member to maintain the pressure transfer position of the pressure transfer member. The fixation device includes a cam that moves a shower wall into a tight corner fit with an adjacent shower wall.

22 Claims, 12 Drawing Sheets

(56) References Cited

U.S. PATENT DOCUMENTS

| | | | | |
|---|---|---|---|---|
| 7,168,117 | B2 * | 1/2007 | Gladney et al. | 5/716 |
| 7,665,718 | B1 * | 2/2010 | Benson | 269/237 |
| 2004/0211039 | A1 * | 10/2004 | Livingston | 24/68 SK |
| 2008/0189922 | A1 * | 8/2008 | Marechal et al. | 24/68 SK |
| 2008/0277849 | A1 | 11/2008 | Phillips, Sr. et al. | |
| 2009/0078843 | A1 | 3/2009 | Trotter | |
| 2009/0223917 | A1 | 9/2009 | Grant et al. | |
| 2009/0277046 | A1 * | 11/2009 | Sartor et al. | 36/118.7 |
| 2013/0047388 | A1 * | 2/2013 | Kavarsky et al. | 24/68 SK |

* cited by examiner

FIG. 1M
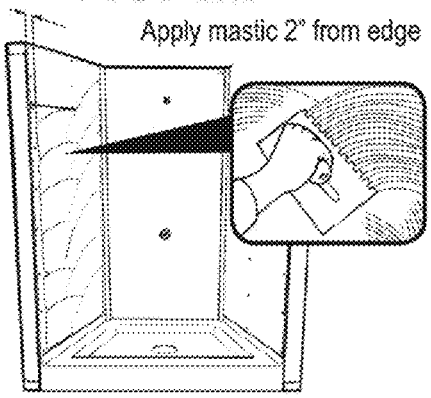
FIG. 1N
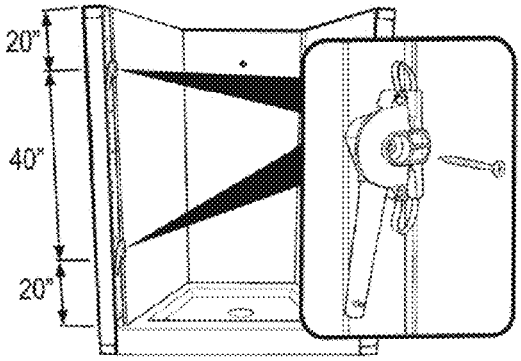
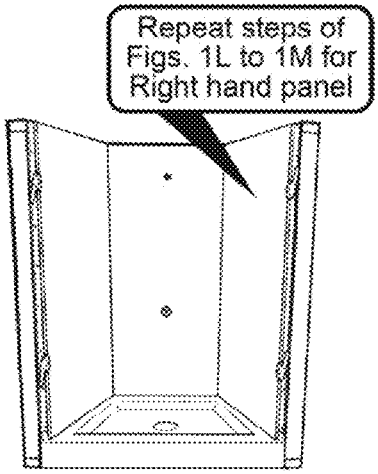
FIG. 1O
FIG. 1P
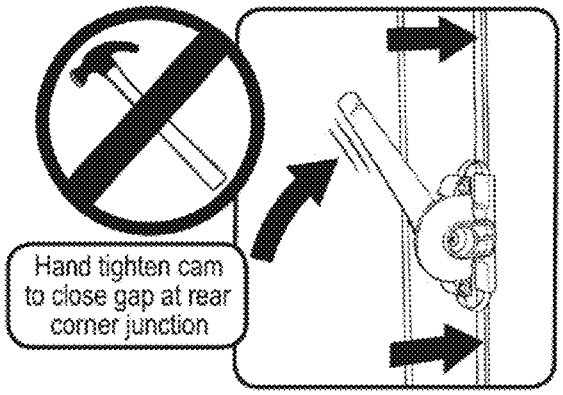
FIG. 1Q
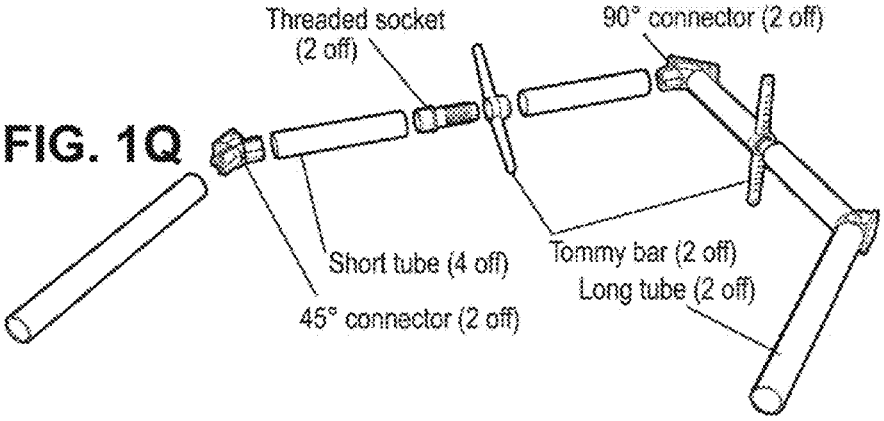

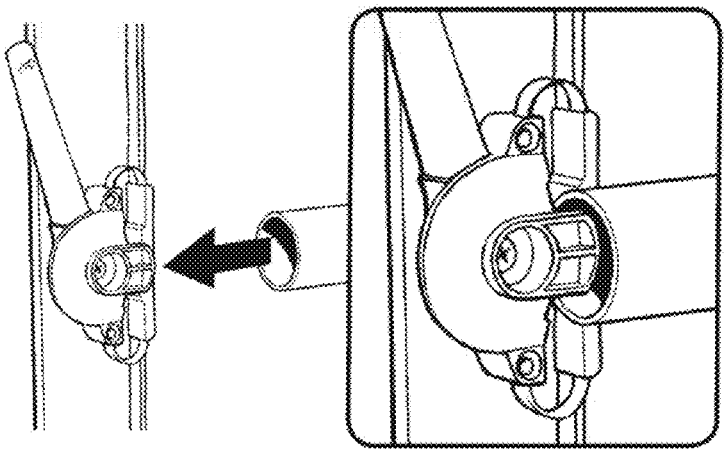
FIG. 1R
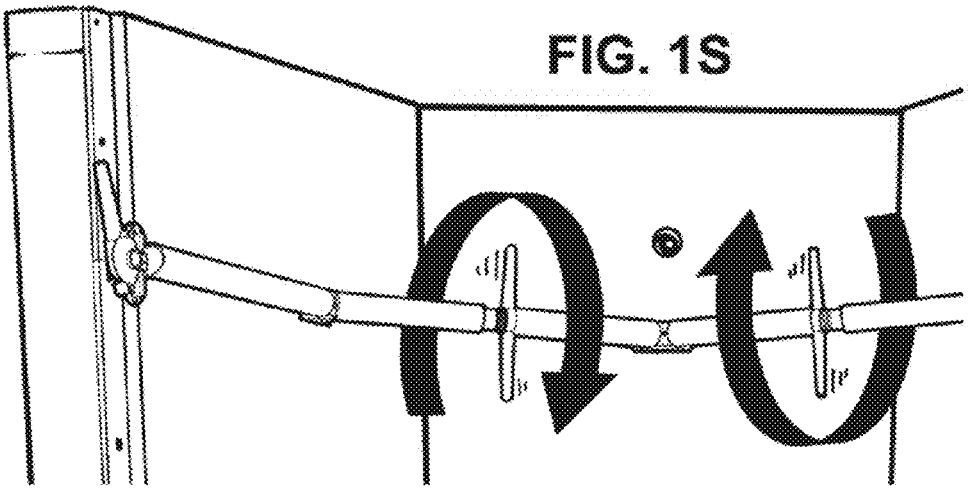
FIG. 1S
FIG. 1T
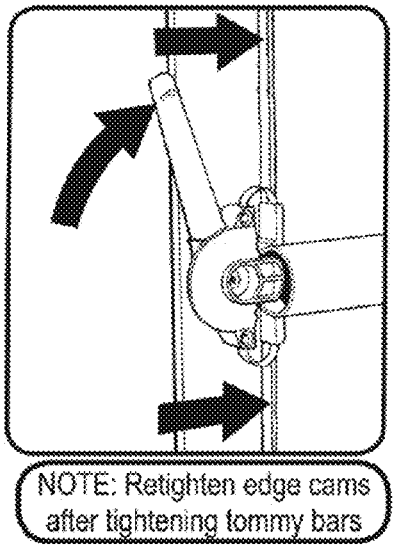
FIG. 1U
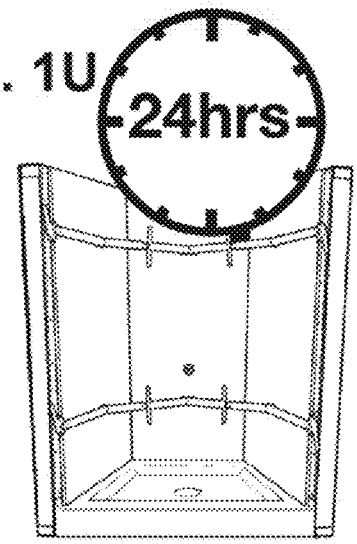

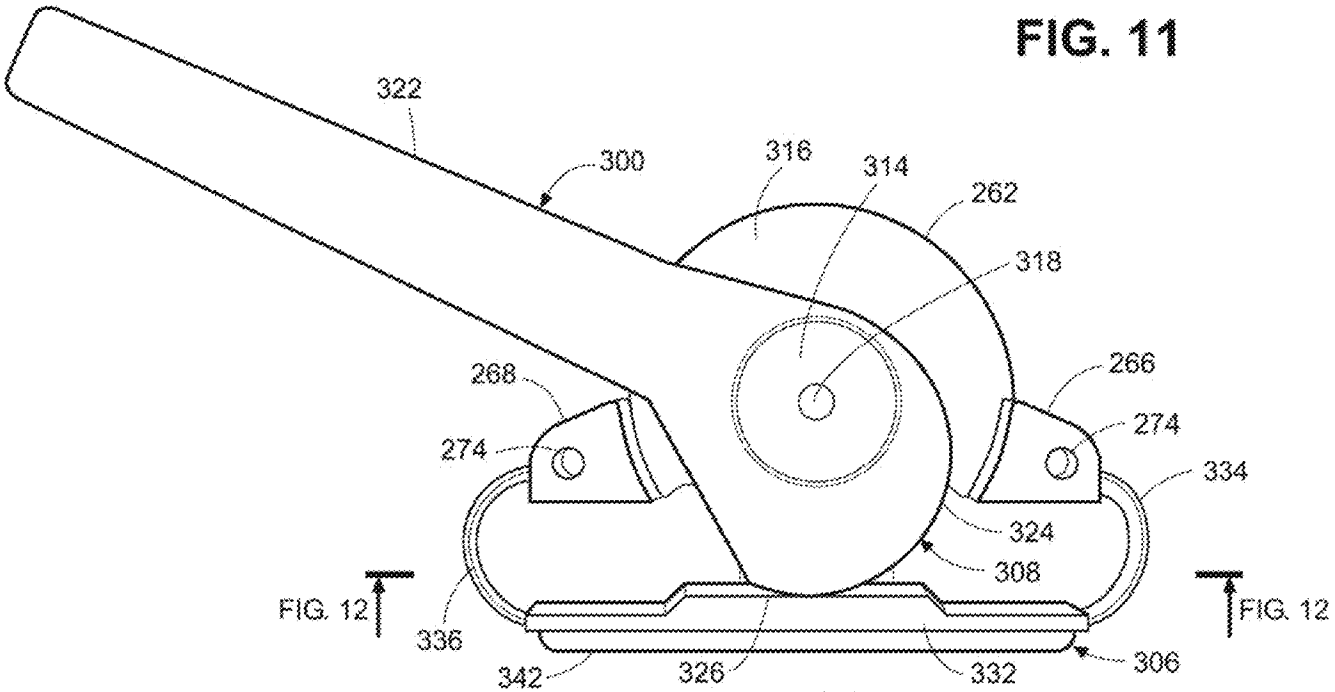
FIG. 11
FIG. 12
FIG. 12
262
266
268
274
274
300
306
308
308
314
316
318
322
324
326
332
334
336
342
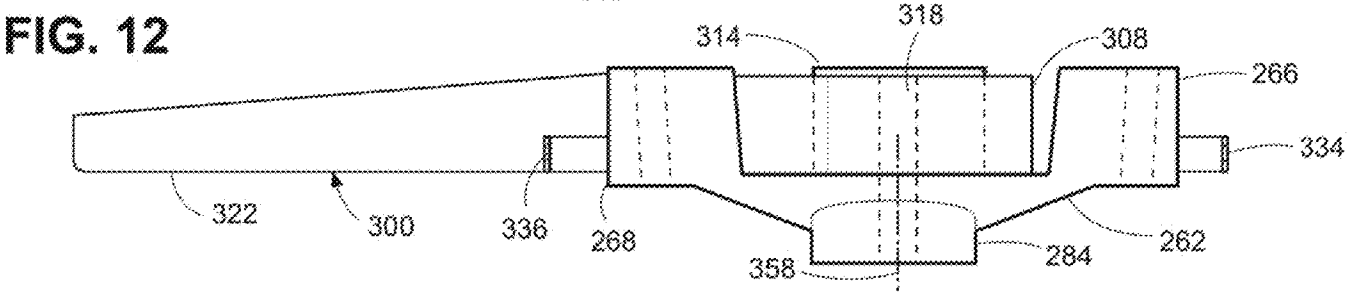
FIG. 12
262
266
268
284
300
308
314
318
322
334
336
358

SYSTEM AND METHOD FOR INSTALLING SHOWER WALLS

BACKGROUND OF THE INVENTION

This invention relates to systems and methods for building shower enclosures, and more particularly to a system and method for installing shower walls in a shower enclosure.

Shower enclosures are usually set up and installed by professionals, especially when the shower walls for such enclosures are formed of a one-piece material such as natural or artificial stone. Stone shower walls generally require custom sizing, and skilled handling for installation in a shower enclosure. The expenses and complexity of such installation may discourage a do-it-yourselfer from using stone or other similar unitary wall structures in shower enclosures.

As used herein the term "shower enclosure" is intended to refer to a shower chamber or shower stall with two or more shower walls, and is closable by a shower door, and can also include one or more fixed glass or plastic panels that extend away from the shower walls to the shower door.

In accordance with the invention unitary shower wall structures (also referred to as shower walls) can be made in predetermined sizes and packaged individually or in a kit. The invention also includes novel installation tools that enable a do-it-yourselfer to install the shower walls. Thus the present system for installing shower walls is amenable for mass marketing as one or more off-the-shelf products.

DESCRIPTION OF THE DRAWINGS

In the accompanying drawings,

FIG. 11 is a rear view of the cam tool and holding device of FIG. 6, showing the cam head in contact with the cam follower, and the molded ribs of FIG. 6 being omitted for purposes of clarity;

FIG. 12 is an auxiliary view of the cam tool and holding device taken on the line 12-12 of FIG. 11; and, FIG. 13 is a view similar to FIG. 11 showing another position of the cam head relative to the cam follower;

Corresponding reference numbers indicate corresponding parts throughout the several views of the drawings.

DETAILED DESCRIPTION OF THE INVENTION

Figure 2:
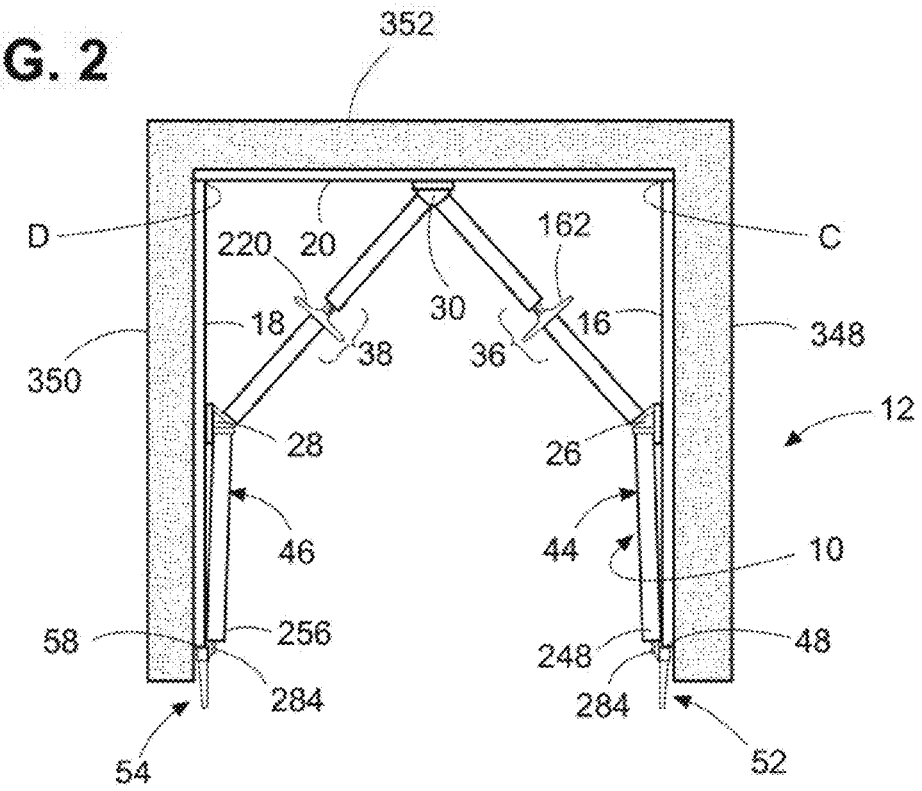
FIG. 2 is a simplified plan view showing one embodiment of the system for installing shower walls, for a three wall shower enclosure.

One embodiment of a system for installing shower walls in a three-wall shower enclosure is generally indicated by the reference number 10 in FIG. 2. The three-wall shower enclosure is generally indicated by the reference number 12, and includes sidewalls 16, 18 and a rear wall 20.

The development of a three-wall shower enclosure is shown in simplified pictorial fashion in FIGS. 1A to 1H.

FIG. 1A to FIG. 1F show a preferred structural framework for a three wall shower enclosure.

Figure 1A:
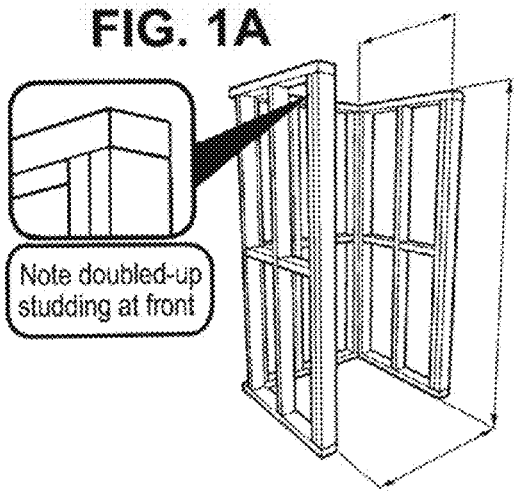
FIG. 1A to FIG. 1X are simplified pictorial diagrams showing the development of a shower enclosure and the installation of shower walls in the shower enclosure using the system for installing shower walls.
Figure 1B:
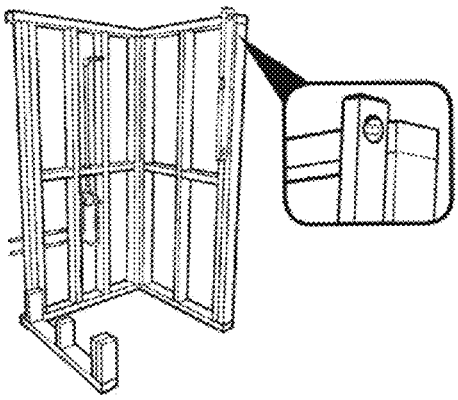
Figure 1C:
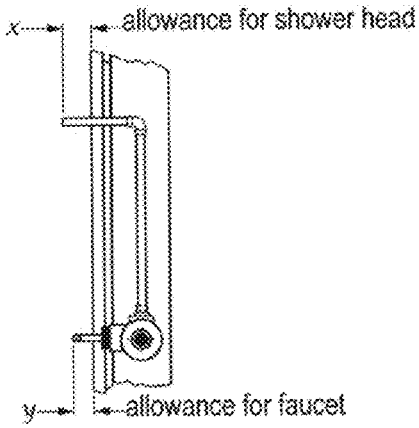
Figure 1D:
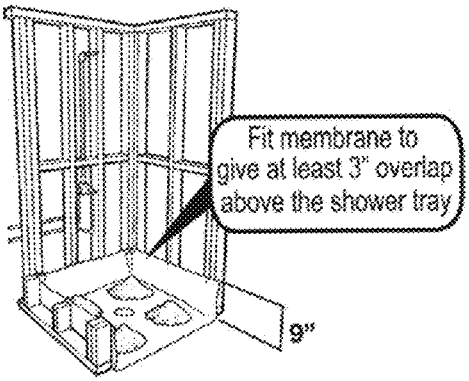
Figure 1E:
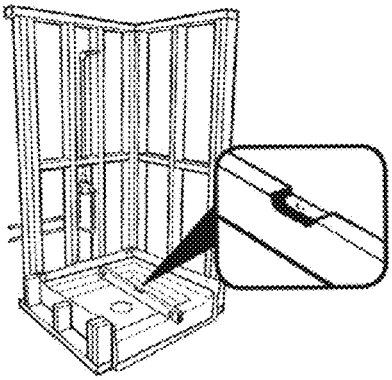
Figure 1F:
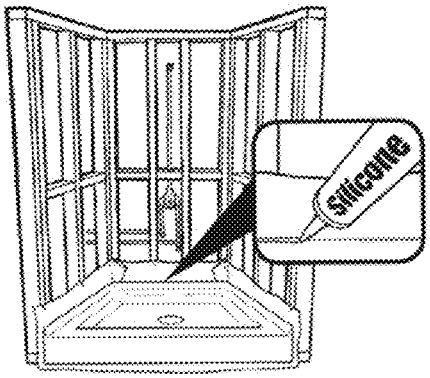
Figure 1G:
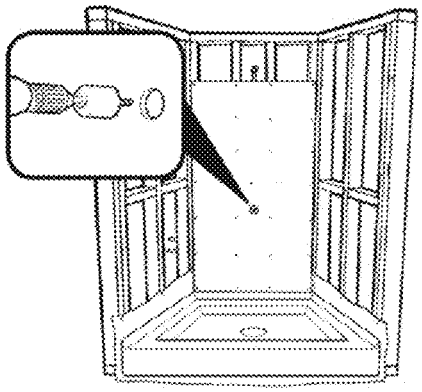
Figure 1H:
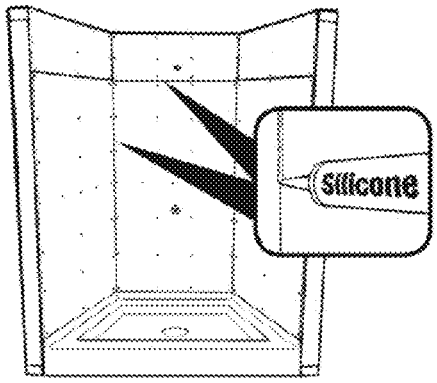
Figure 1I:
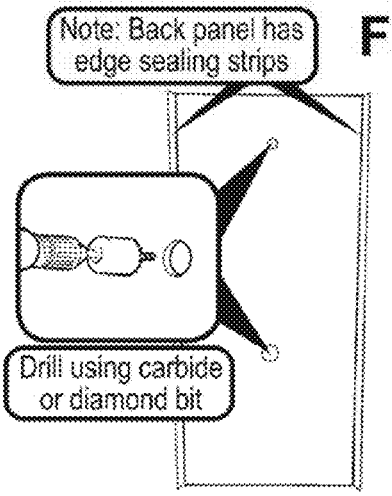
Figure 1J:
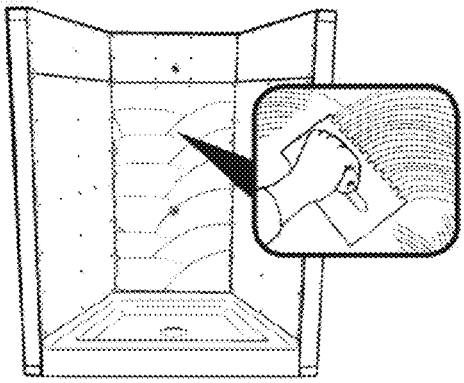
Figure 1K:
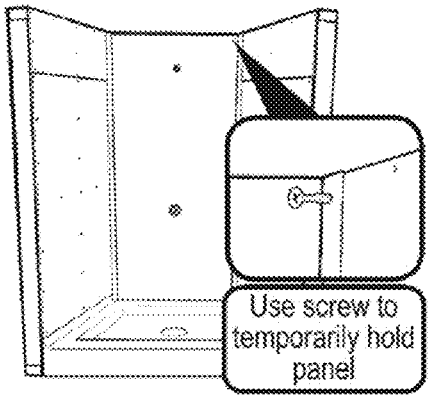
Figure 1L:
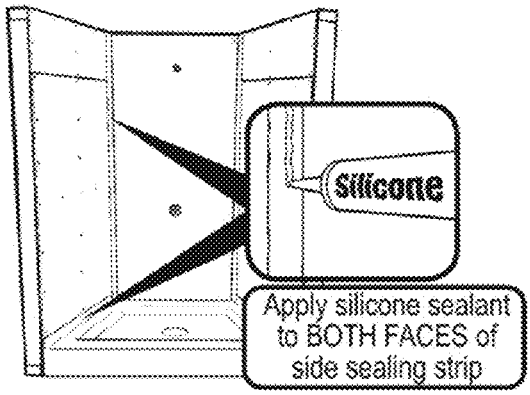

FIGS. 1G to 1H show the installation of backup support walls for the shower walls, and a shower floor tray with a drain for the shower enclosure.

FIGS. 1I to 1M show a bonding material being provided on the front of the backup support walls for securement of the shower walls on the backup support walls.

FIGS. 1M to 1U show the shower walls in their initial placement position against the backup support walls.

FIGS. 1N to 1U show the system for holding or installing the shower walls in a desired securement position against the backup support walls in the shower enclosure until a bonding material for the shower walls dries and cures.

Figure 1V:
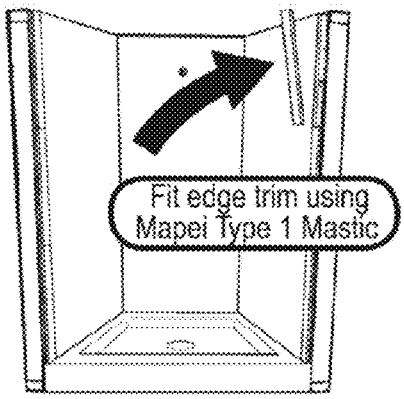
Figure 1W:
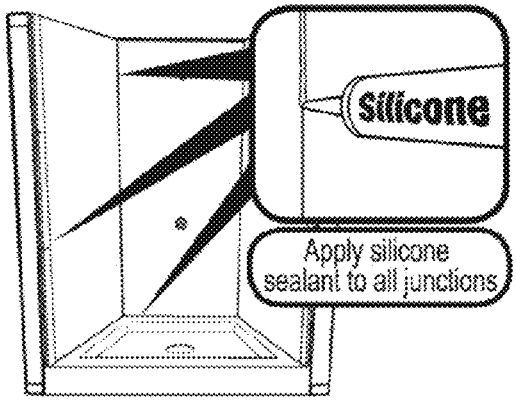
Figure 1X:
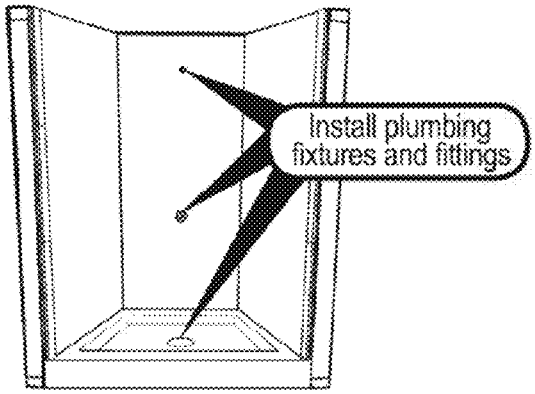

FIGS. 1V to 1X show finishing operations for the shower walls after the shower walls are sufficiently secured in the shower enclosure.

It should be noted that any structural dimensions and bonding material cure times indicated in FIG. 1A to FIG. 1X are for example, and are not intended to exclude other feasible dimensions or cure times.

Each shower wall is preferably a laminate of a natural or synthetic stone material such as granite or marble, or a synthetic stone-like material bonded to a backup support layer. The stone or stone-like layer can be approximately 4 mm thick, for example. A suitable bonding adhesive is a combination of Magpow Aluminum Honeycomb Compound Glues 1693A, 1693B, 1693-1(A) and 1693-1(B).

The backup layer for the stone or synthetic stone layer is preferably formed of a flexible PVC material that is fluted at its rear surface. The fluting can be accomplished with a BF2010022 die. The fluted surface provides the backup layer with a desired yieldability under pressure. Such yieldability helps ensure a secure bond between the shower walls and the backup support walls in the shower enclosure.

Referring to FIG. 2 of the drawings, the system 10 for installing the shower walls is used to press against and hold in a desired securement position the side shower walls 16, 18 and the rear shower wall 20 (FIGS. 2 and 3) of the shower enclosure 12, until a bonding material (FIGS. 1H, 1L and 1M) for the shower walls 16, 18 and 20 dries or cures to create a secure bond.

Figure 4:
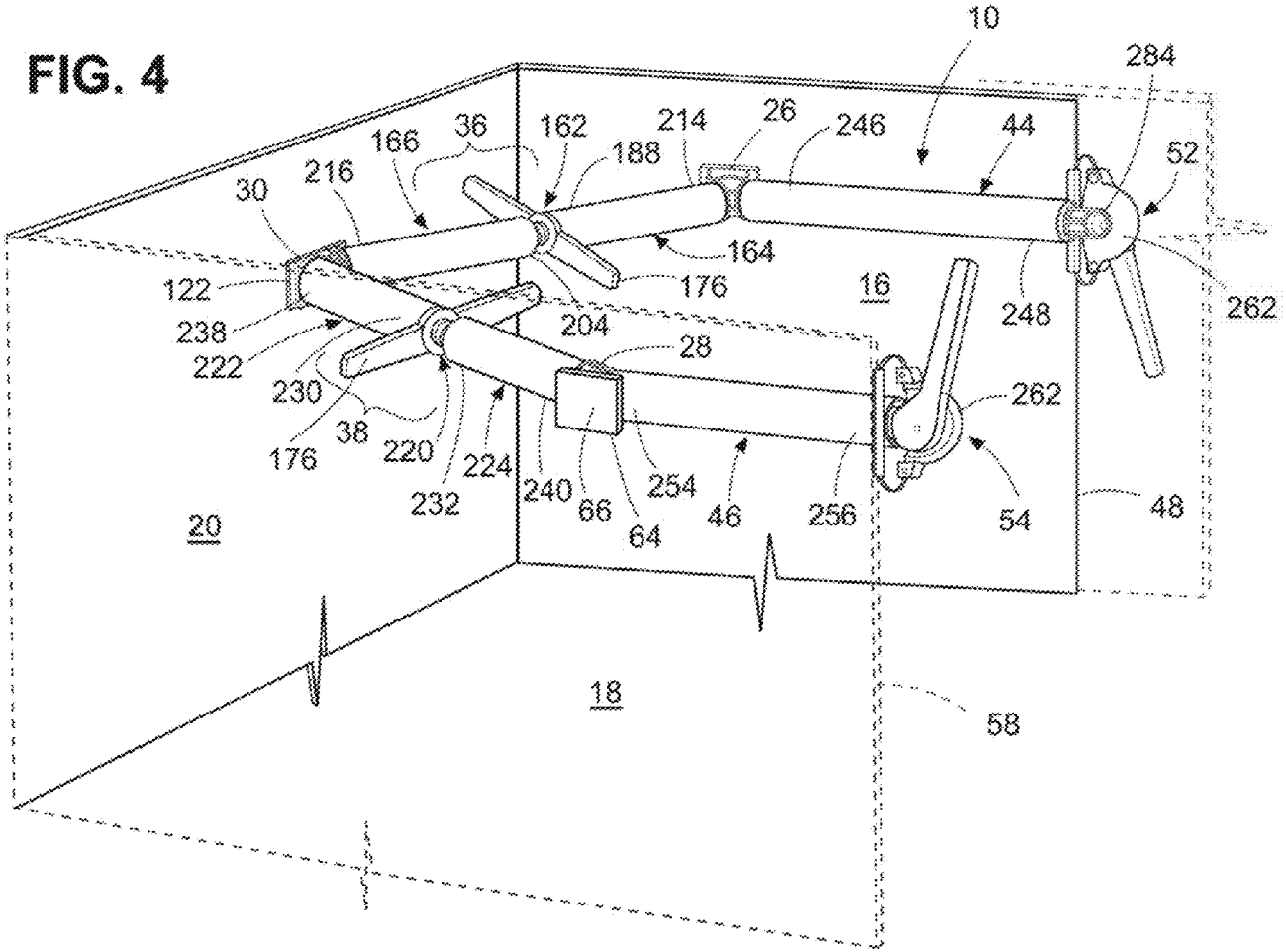
FIG. 4 is an enlarged perspective view of the system of FIG. 2 with the backup support walls of the shower enclosure being generally omitted for purposes of clarity.

As shown in FIG. 1U one shower wall installation system, identified by the reference number 10 in FIGS. 2 and 4, can be used at an upper portion of the shower walls and a second shower wall installation system 10 can be used at a lower portion of the shower walls.

The system 10 (FIGS. 2 and 4) includes pressure transfer members 26 and 28 for the side shower walls 16 and 18, and a pressure transfer member 30 for the rear shower wall 20. Pressure is applied to the pressure transfer members 26, 28 and 30 by adjustable force development devices 36 and 38 (FIG. 2) which engage the pressure transfer members 26, 28 and 30.

The system 10 (FIGS. 2 and 4) further includes support members in the form of elongated struts or pipes 44, 46 which can be formed of any suitable material such as 1½ inch diameter plastic tube, which respectively engage the pressure transfer members 26 and 28.

The system 10 also includes a combination cam tool and holding device 52 (FIGS. 2 and 4) that engages the support member 44 and an edge 48 of the sidewall 16.

The system 10 further includes an identical cam tool and holding device 54 (FIGS. 2 and 4) that engages the support member 46 and an edge 58 of the sidewall 18.

The pressure transfer members 26 and 28 (FIG. 9) include a base portion 64 having a pressure transfer surface 66 (FIG. 4) that is directed against the respective shower walls 16 and 18 (FIGS. 2 and 4). The pressure transfer members 26 and 28 (FIG. 9) also include engagement arms 72 and 74 that have an intersection angle A of approximately 135°, although other angles are also feasible.

The arms 72 and 74 (FIG. 9) have upper and lower fins 80, 82, 84, 86 and 88 that extend upwardly and downwardly from a shelf 90. The fins 82, 82, 84, 86 and 88 provide the arms 72 and 74 with strength, rigidity and lightness of weight.

The fins 80 and 88 (FIG. 9) have contact surfaces 94 and the fins 82, 84 and 86 have opposite contact edges 96, 98 and 100. The contact surfaces 94 and the contact edges 96, 98 and 100 are elements or segments of an imaginary cylindrical surface.

The arms 72 and 74 (FIG. 9) project from spaced sidewalls 102 and 104 that extend from the base portion 64 and are joined by ribs 110, 112 and 114. The pressure transfer members 26 and 28 are preferably molded from a suitable known plastic.

The pressure transfer member 30 (FIG. 10) includes a base portion 120 having a pressure transfer surface 122 that is directed against the rear shower wall 20 (FIG. 4). The pressure transfer member 30 also includes engagement arms 128 and 130 that have an intersection angle B of approximately 90°, although other angles are also feasible.

The engagement arms 128 and 130 are finned in the same manner as the arms 72 and 74 of the pressure transfer members 26 and 28, and are thus identified by corresponding reference numbers.

The arms 128 and 130 (FIG. 10) project from spaced sidewalls 136 and 138 that extend from the base portion 120. The sidewalls 136 and 138 are joined by ribs 144, 146 and 148 that also intersect a median wall 154 that extends from the base portion 120. As with the pressure transfer members 26 and 28 the pressure transfer member 30 is preferably molded from a suitable known plastic material.

Figure 7:
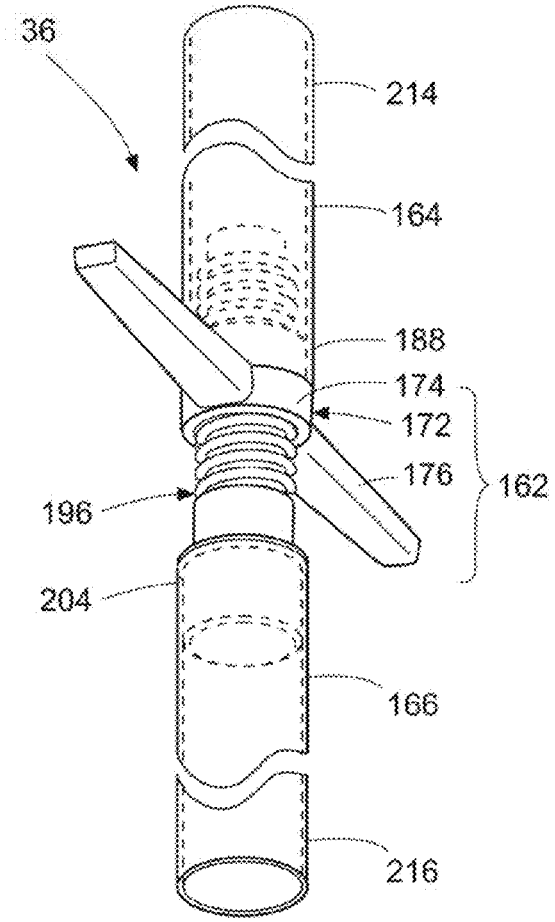
FIG. 7 is an enlarged perspective view of an adjustable force development device for the system, including a crank assembly.

The adjustable force development device 36 (FIGS. 2, 4 and 7), which is identical to the force development device 38, includes a threaded jack assembly or threaded Tommy bar assembly 162 cooperable with a pair of elongated struts 164 and 166 (FIGS. 4 and 7).

Figure 8:
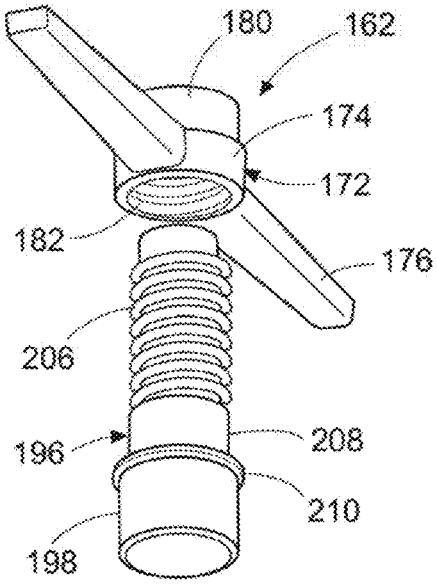
FIG. 8 is an exploded view of the crank assembly of FIG. 7.

As shown in FIGS. 7 and 8, the jack assembly 162 includes a hollow crank member 172 having a central hub portion 174 with a turn handle 176. The hub portion 174 has a projecting end 180 (FIG. 8) of reduced diameter. The crank member 172 is provided with internal threads 182.

The projecting end 180 fits into an end 188 (FIGS. 4 and 7) of the strut 164 for relative turning movement with respect to the strut 164 via the turn handle 176.

The jack assembly 162 also includes a hollow externally threaded member 196 (FIGS. 7 and 8) having a strut engaging end 198 (FIG. 8) that fits tightly or is locked into a confronting open end 204 of the strut 166. The tight fit or lock fit prevents relative movement of the externally threaded member 196 with respect to the strut 166.

The externally threaded member 196 has a threaded portion 206 on a reduced diameter section 208 that extends away from the strut engaging end 198. A peripheral bead 210 that limits insertion of the threaded member 196 into the strut 166 is formed on the strut engaging end 198 where it intersects the reduced diameter section 208. The threaded portion 206 is engageable with the internal threads 182 of the rotatable crank member 172 as shown in FIG. 7.

Under this arrangement, rotation of the turn handle 176 of the jack assembly 162 (FIG. 8) causes threaded movement of the crank member 172 relative to the nonturnable threaded member 196, to provide a desired spacing between the confronting ends 188 and 204 (FIGS. 4 and 7) of the struts 164 and 166.

Figure 9:
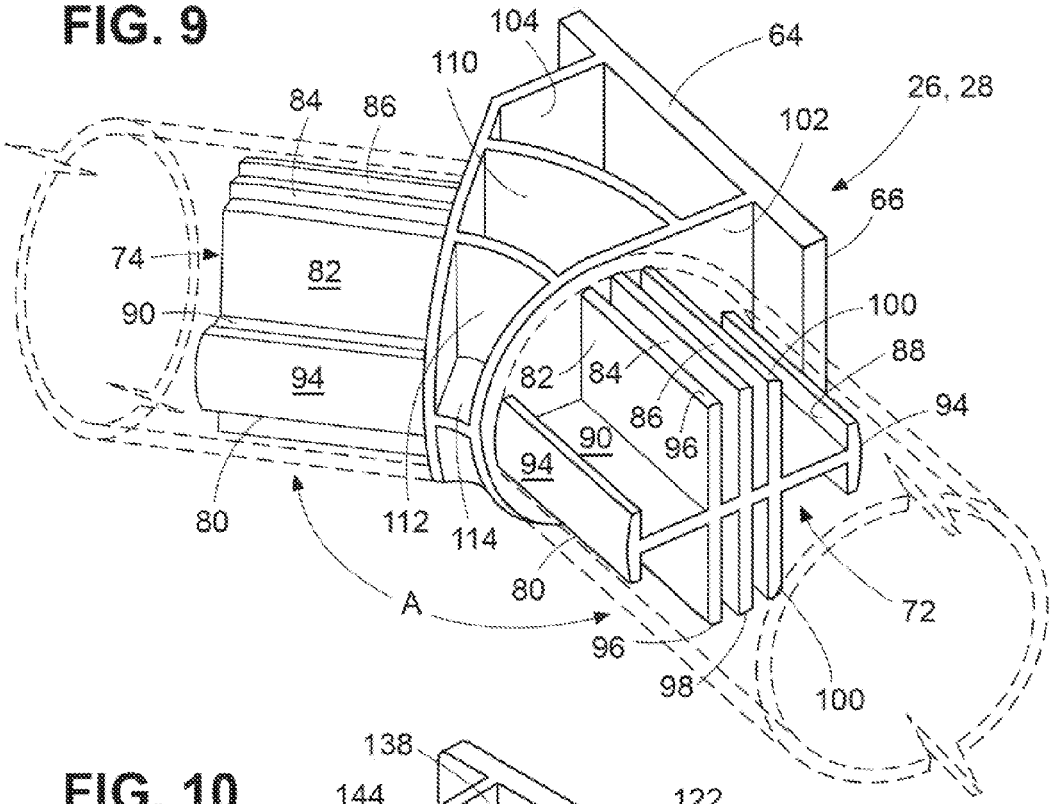
FIG. 9 is a perspective view of one pressure transfer member of the system.
Figure 10:
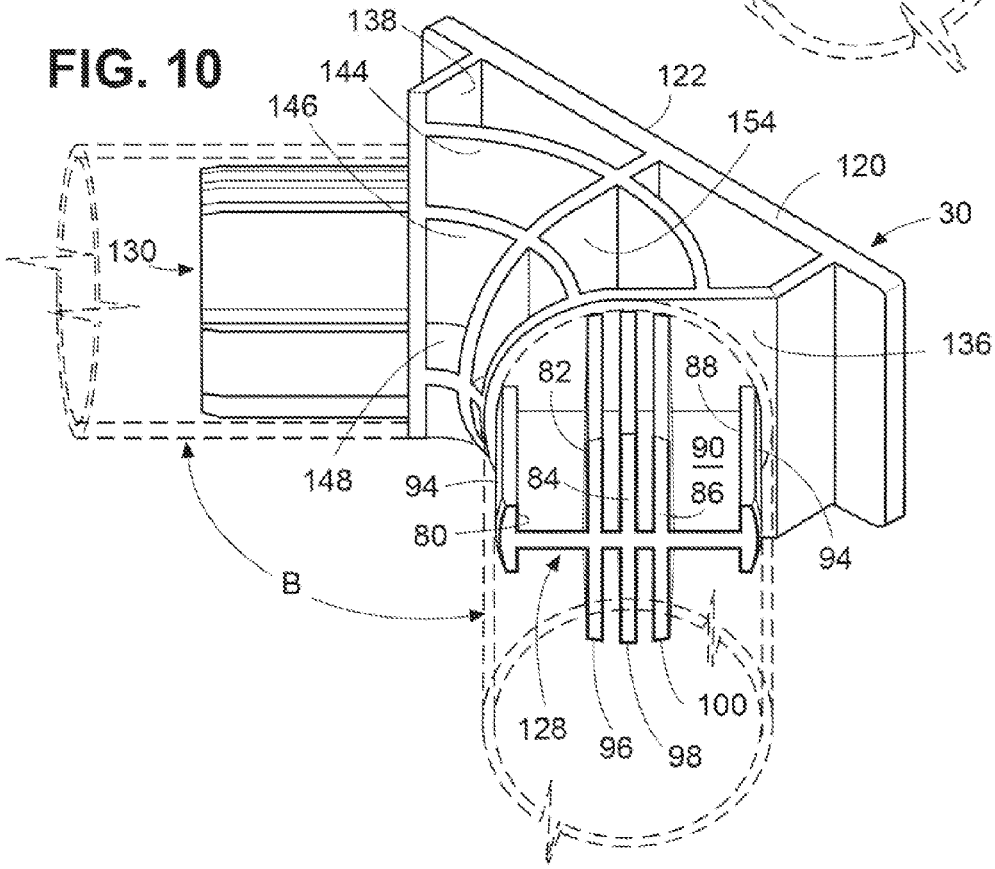
FIG. 10 is a perspective view of another pressure transfer member of the system.

An opposite force transmitting end 214 of the strut 164 (FIGS. 4 and 8) engages the pressure transfer member 26 at the arm 74 (FIG. 9). An opposite force transmitting end 216 (FIGS. 2 and 8) of the strut 166 (FIGS. 4 and 7) engages the pressure transfer member 30 at the arm 128 (FIG. 10).

The struts 164 and 166 can be formed of any suitable material such as 1½ inch diameter plastic tube.

The force development device 38 includes a threaded crank assembly 220, identical to the crank assembly 162, cooperable with a pair of elongated struts 222 and 224, (FIG. 4) identical to the struts 164 and 166. The force development device 38 is assembled and operates in a manner similar to that previously described for the force development device 36.

Thus, an end 230 (FIG. 4) of the strut 222 engages the crank member 172 of the jack assembly 220. A confronting end 232 of the strut 224 (FIG. 4) engages the externally threaded member 196 of the jack assembly 220. Under this arrangement turning movement of the turn handle 176 provides a desired spacing between the confronting ends 230 and 232 of the struts 222 and 224.

An opposite force transmitting end 238 (FIG. 4) of the strut 222 engages the pressure transfer member 30 at the arm 130 (FIG. 10). An opposite force transmitting end 240 of the strut 224 engages the pressure transfer member 28 (FIG. 4) at the arm 72 (FIG. 9). Thus turning of the turn handle 176 of the jack assembly 220 provides a desired spacing between the confronting ends 230 and 232 of the struts 222 and 224.

The elongated support member 44 has an end 246 (FIG. 4) that engages the pressure transfer member 26 at the arm 72 (FIG. 9). An opposite end 248 of the support member 44 engages the cam tool and holding device 52.

Similarly, the elongated support member 46 has an end 254 (FIG. 4) that engages the pressure transfer member 28 at the arm 72 (FIG. 9). An opposite end 256 of the support member 46 engages the cam tool and holding device 54.

The cam tool and holding device 52 (FIG. 4) includes a base 262 with opposite peripheral ear portions 266 and 268 (FIGS. 5, 6, 11 and 13. A fastener opening 274 (FIG. 11) is provided in each ear portion 262 and 268 for reception of a fastener 276 (FIG. 5) for securing the base to a backup support wall 348 next to the edge 48 of the shower wall 16. Such securement establishes the fixation position of the device 52.

A support stub 284 (FIGS. 5 and 13) is formed on or joined to a top surface 290 (FIG. 5) of the base 262 and extends beyond a peripheral edge 292 (FIGS. 5 and 13) of the base 262. The support stub 284 is engageable with the end 248 of the support member 44 (FIGS. 2, 4 and 5) for supporting the end 248 in a position that is determined by the fixation position of the device 52.

The device 52 thus holds the support member 44 in its support position, wherein the support member 44 engages the pressure transfer member 26 (FIGS. 2 and 4) to maintain the pressure transfer member 26 in a desired pressure transfer position against the shower wall 16.

The cam tool and holding device 54, which is identical to the cam tool and holding device 52, is secured to a backup support wall 350 (FIG. 2) next to the edge 58 of the shower wall 18, to establish the fixation position of the device 54.

The device 54 also includes a support stub 284 that engages the end 256 (FIGS. 2 and 4) of the support member 46 when the device 54 is fixed in position on the support wall 350. The device 54 thus supports the end 256 of the support member 46 in a position that is determined by the fixation position of the device 54.

The device 54 therefore holds the support member 46 in a support position, wherein the support member 46 engages the pressure transfer member 28 (FIGS. 2 and 4) to maintain the pressure transfer member 28 in a desired pressure transfer position against the shower wall 18.

The cam tool and holding device 52 further includes a cam 300 and a cam follower 306. The cam 300 has a cam head 308 that is rotatable on a hub portion 314 that projects from a bottom surface 316 of the base 262, and is integral with the base 262.

Figures 5, 6:
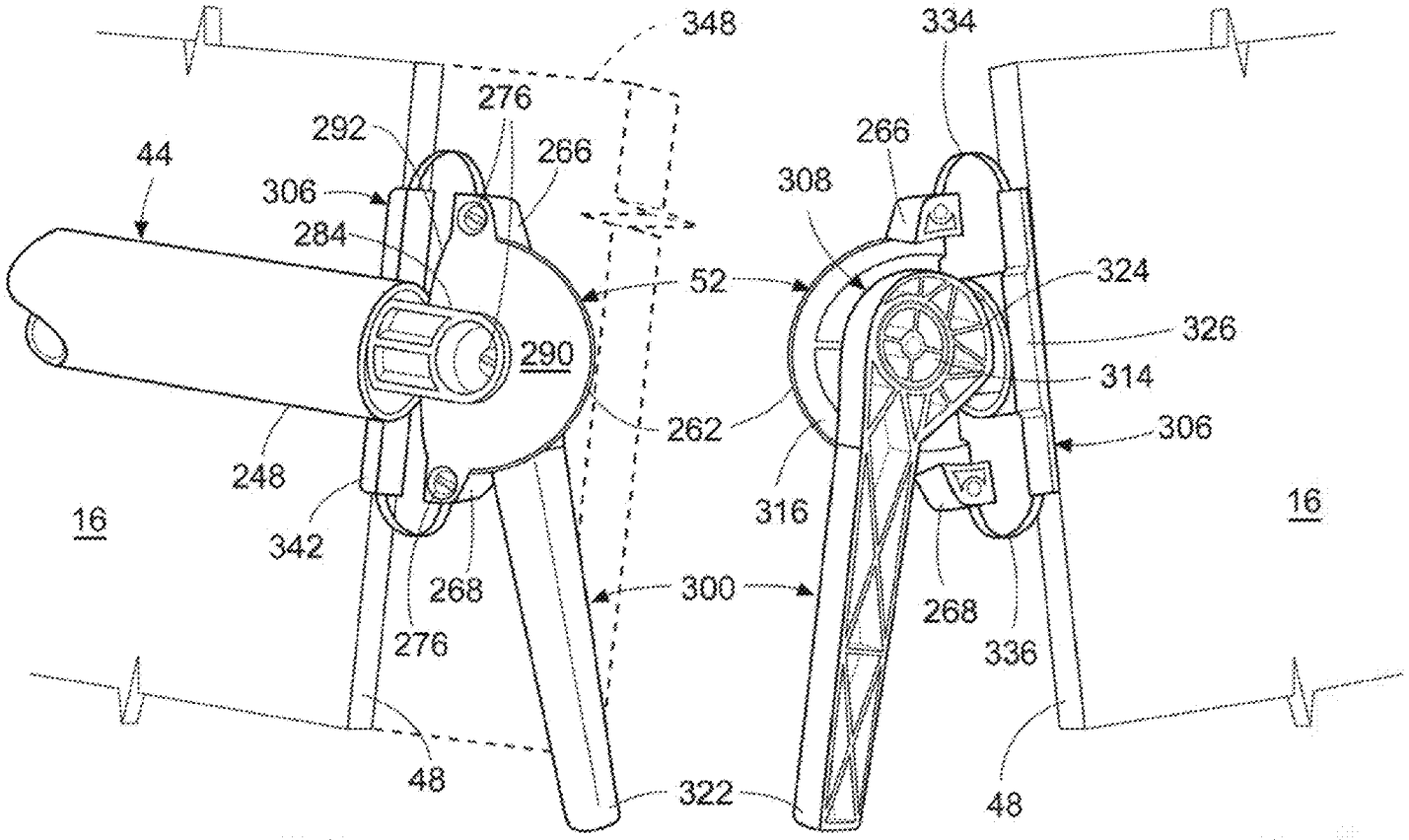
FIG. 5 is an enlarged perspective front view of a cam tool and holding device for the system, positioned against an edge of one of the shower walls.
FIG. 6 is an enlarged perspective rear view of the cam tool and holding device of FIG. 4.

The hub portion 314 is formed with an opening 318 (FIGS. 11-13) for a fastener 276 (FIG. 5).

A cam lever arm 322 (FIGS. 5 and 6) extends from the cam head 308. The cam head 308 has a cam surface 324 (FIGS. 6, 11 and 13) engageable with a cam engagement surface 326 on the cam follower 306.

The cam surface 324 or the cam engagement surface 326 can be provided with faceting (not shown) to reduce slippage between the surfaces 324 and 326 when engagement occurs.

The cam follower 306 has a driving surface 332 (FIGS. 11 and 13) opposite the cam engagement surface 326. The driving surface 332 (FIGS. 11-13) is engageable with the edge 48 (FIGS. 5 and 6) of the shower wall 16.

The cam follower 306 also includes flexible end straps 334 and 336 (FIGS. 5, 6 and 11-13) respectively joined to the ear portions 266 and 268 of the base 262 to permit movement of the cam follower 306 with respect to the base 262. The cam follower 306, the straps 334, 336, the base 262 and the ear portions 266 and 268 can be molded as a one-piece structure.

Figure 13:
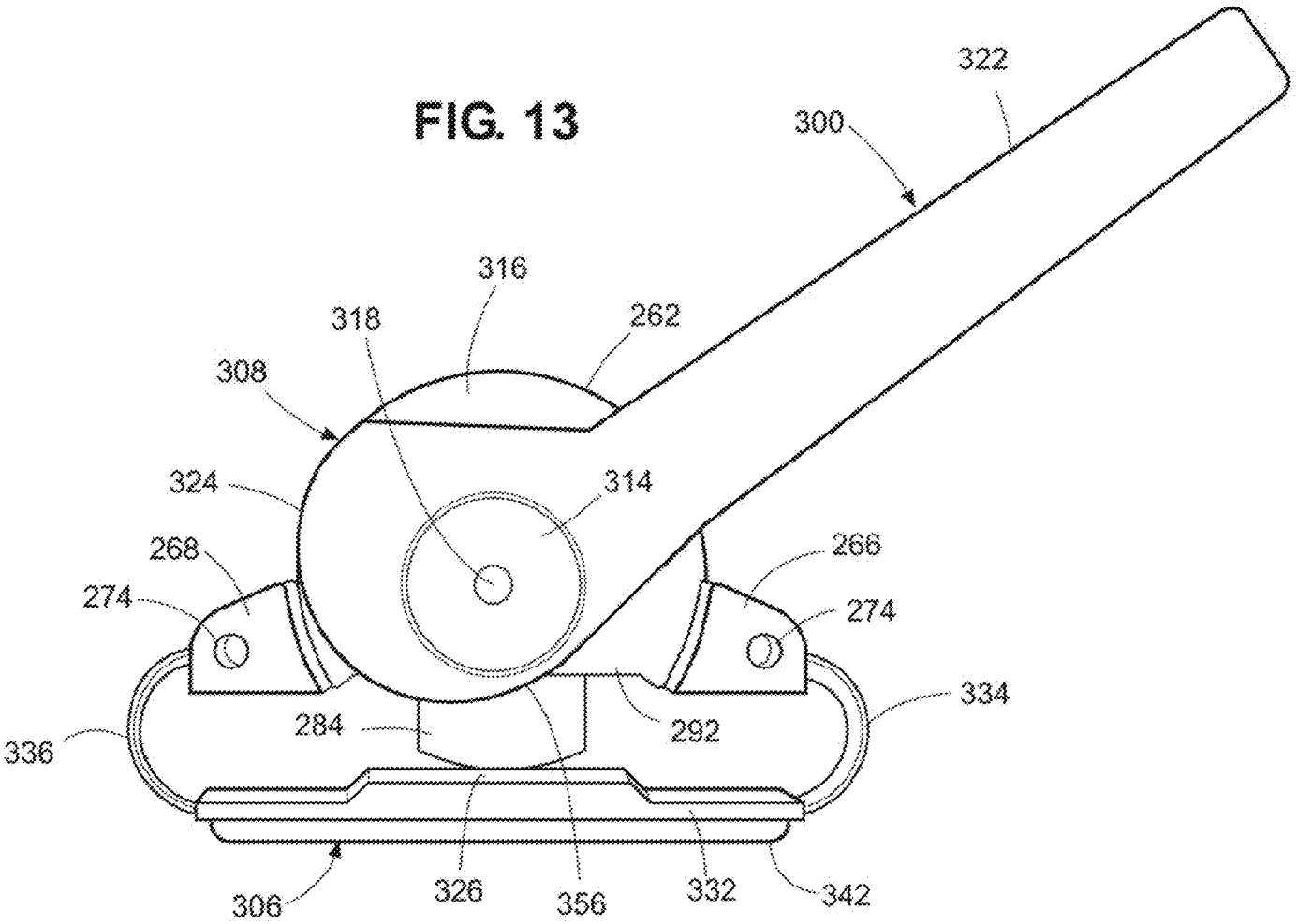

The cam follower further includes a surface contacting portion 342 for contacting the exposed surface of the shower wall 16 (FIGS. 5, 11 and 13).

The cam tool and holding device 54 also includes a cam 300 rotatably mounted on a hub 314, and a cam follower 306, as previously described for the cam tool and holding device 52.

During installation of the shower walls 16, 18 and 20 the walls 16, 18 and 20 are positioned in the shower wall enclosure 12 in a manner generally indicated in the FIGS. 1H to 1P. The shower walls 16, 18 and 20 are thus placed against the backup support walls 348, 350 and 352 (FIG. 2A), which are provided with a bonding material.

The bonding material will ultimately form a permanent bond between the shower walls 16, 18 and 20, and their backup support walls 348, 350 and 352.

However, to ensure adequate surface contact between the shower walls 16, 18 and 20, and their respective backup support walls 348, 350 and 352, it is desirable to apply pressure on the shower walls 16, 18 and 20 while the bonding material cures.

The system 10 provides the desirable pressure on the shower walls 16, 18 and 20 during the curing period of the bonding material.

Figure 3:
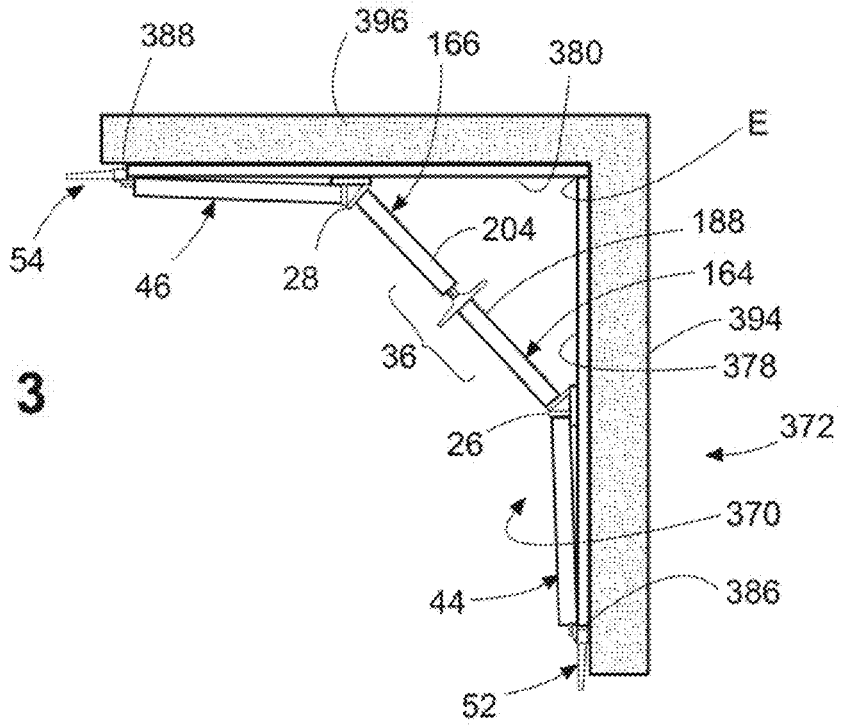
FIG. 3 is a simplified plan view of another embodiment of the system for installing shower walls, for a two wall shower enclosure.

However, before the entire system 10 is placed in the position of FIGS. 2 and 3, the cam tool and holding devices 52 and 54 are first installed. The devices 52 and 54 are initially used to slide the side shower walls 16, 18 against the rear shower wall 20. Thus when the bonding material cures a tight joint will be provided at the corners C and D (FIG. 2) between the side shower walls 16, 18 and the rear shower wall 20.

The cam tool and holding device 52 and 54 are thus affixed alongside the edges 48 and 58 of the shower walls 16 and 18 (FIGS. 2 and 4) in the manner indicated in FIG. 1R. If two sets of the system 10 are to be used, two cam tools and holding devices 52 are provided at the edge 48 of the shower wall 16 and two cam tools and holding devices 54 are provided at the edge 58 of the of the shower 18 in a manner similar to that indicated in FIG. 1X.

The cam tool and holding devices 52 and 54 are located relative to the edges 48 and 58 of the shower walls 16 and 18 such that the driving surface 332 of the cam follower 306 contacts the edges 48 and 58 of the shower walls 16 and 18 while a portion 356 (FIG. 13) of the cam surface 324 having the smallest radial distance from the cam pivot axis 358 (FIG. 12) at the center of the fastener opening 318 is arranged to contact the cam engagement surface 326 of the cam follower 306.

Under this arrangement rotation of the handle 322 of the cam 300 will cause the cam surface 324 to forcibly engage the cam engagement surface 326 on the cam follower 306. The force exerted by the cam surface 326 on the cam follower 306 is transferred to the driving surface 332 of the cam follower 306 that engages the edge 48 of the side wall 16, for example. Such force will urge the side wall 16 to slide toward the rear wall 20 thereby creating a tight corner engagement at the corner C between the wall 16 and the wall 20.

A similar operation is provided with the cam tool and holding tool 54 to cause the side shower wall 18 to slide toward the rear shower wall 20 thereby creating a tight corner joint at corner D between the wall 18 and the wall 20.

Once the tight corner joints have been established at the corners C and D (FIGS. 2 and 3) the other components of the system 10 in addition to the earn tool and holding devices 52 and 54 are put in place as shown in FIG. 3.

Thus the pressure transfer members 26, 28 and 30 are engaged with the adjustable force development means 36 and 38. The support members 44 and 46 are engaged with the pressure transfer members 26 and 28 as shown in FIGS. 2 and 3. The crank devices 36 and 38 of the force development devices are in a relatively light force development condition to facilitate location of the pressure transfer members 26, 28 and 30 on the shower walls 16, 18 and 20 in a desired pressure transfer position.

It will be noted that the cam tool and holding devices 52 and 54 in their previously affixed positions, dictate the height at which the system 10 is positioned in the shower enclosure 12.

Referring to FIGS. 2 and 4 with the system 10 thus positioned the crank devices 36 and 38 are rotated in a counterclockwise direction, for example, to spread the confronting ends of the struts 164 and 166 and thereby impose a force on the pressure transfer members 26 and 30 via the struts 164 and 166.

Similarly counterclockwise rotation of the crank member 220 of the force development device 38 will spread the confronting ends 230 and 232 of the struts 222 and 224 to impose a force on the pressure transfer members 28 and 30 via the struts 222 and 224.

The pressure transfer members 26 and 28 are held in position by the support members 44 and 46 and the pressure transfer member 30 is held in position, by a combination of the force imposed thereon by the force development devices 36 and 38 and the stabilization of the pressure transfer members 26 and 28 by the support members 44 and 46 and the devices 52 and 54.

The devices 52 and 54 hold the support members 44 and 46 in their respective support positions and ultimately maintain the pressure transfer members 26, 28 and 30 in their respective pressure transfer positions.

The affixation of the devices 52 and 54 alongside the shower walls 16 and 18 ensures stability of the system 10 during the installation of the shower walls 16, 18 and 20.

After a desirable cure period for the bonding material has elapsed, such as for example 24 hours, the system 10 can be removed from the shower walls 16, 18 and 20 by reducing the force imposed by the force development devices 36 and 38, disengaging the force development devices 36, 38 from the respective pressure transfer members 26, 28 and 30 and removing the support struts 44 and 46 from the devices 52 and 54. The devices 52 and 54 can then be detached from their affixed position alongside the edges 48 and 58 of the shower walls 16 and 18.

In another embodiment of the invention a system for installing shower walls in a two wall shower enclosure is generally indicated by the reference number 370 in FIG. 3. The two wall shower enclosure is generally indicated by the reference number 372, and includes shower walls 378 and 380. The shower walls 378 and 380 intersect at a corner angle E of approximately 90°, although other intersection angles are also feasible.

The system 370 (FIG. 3) includes the pressure transfer members 26 and 28 for the shower walls 378 and 380. Pressure is applied to the pressure transfer members 26 and 28 by the adjustable force development 36 (FIGS. 7 and 8) which engage the pressure transfer members 26 and 28.

The system 370 (FIG. 3) further includes the support members 44 and 46 which respectively engage the pressure transfer members 26 and 28.

The system 370 also includes the combination cam tool and holding devices 52 and 54 (FIGS. 5-13) that engage the support members 44 and 46.

The cam tool and holding devices 52 and 54 also engage edges 386 and 388 of the shower walls in a manner similar to that described for the system 10 engagement of the shower wall edges 44 and 58 by the devices 52 and 54.

The system 370 is operated in a manner similar to that previously described for the system 10. Thus the force development device 36 is operated to increase the space or distance between the confronting ends 188 and 204 of the struts 164 and 166 to impose a force on the pressure on the pressure transfer members 26 and 28 as previously described for the system 10.

The forces exerted on the pressure transfer members 26 and 28 are applied against the shower walls 378 and 380 after they have been shifted into a tight corner joint by the cam tool and holding devices 52 and 54 in a manner similar to that previously described for the system 10.

Thus the system 370 presses against and maintains the shower walls 378 and 380 in a desired securement position against backup support walls 394 and 396 until a bonding material for the shower walls dries and cures.

As various changes can be made in the above constructions and methods without departing from the scope of the invention, it is intended that all matter contained in the above description or shown in the accompanying drawings shall be interpreted as illustrative and not in a liming sense.

What is claimed is:

1. A system for installing shower walls comprising, a) two pressure transfer members respectively locatable in spaced elevated positions on two shower walls, each said pressure transfer member having two side portions and a base, the side portions extending away from the base, the base having a planar pressure transfer surface for applying pressure against a separate shower wall to urge the shower wall against a shower wall support, b) an adjustable force development device engaged with one said side portion of each said pressure transfer member for directing a developed force or forces simultaneously through the respective said pressure transfer surfaces against separate shower walls, c) two elongated support members having opposite ends, one end of each said elongated support member being respectively engaged with the other side portion of each said pressure transfer member, and the opposite end of each said elongated support member being supportable in a fixed position, d) a pair of holding devices respectively engaged with the opposite supportable end of each said elongated support member to hold said opposite supportable ends in respective fixed positions, each said holding device having attachment means for securing the holding device to a shower wall support in the respective fixed positions and each said holding device including means for moving the shower wall in a predetermined direction.

2. The system of claim 1 wherein said moving means include a rotatable cam and a cam follower for engaging an end of a shower wall to urge the shower wall to move or slide in response to rotation of the cam with respect to the cam follower.

3. The system of claim 2 wherein the rotatable cam includes a base and a cam head pivotable with respect to the base, the cam head having a cam surface and a lever arm joined to the cam head, the cam follower having a cam engagement surface engageable with the cam surface.

4. The system of claim 3 wherein the cam follower is connected to the base by flexible connection means that permit relative movement of the can follower and the cam head toward and away from each other.

5. The system of claim 4 wherein said flexible connection means include a flexible strap member.

6. The system of claim 3 wherein said attachment means include a fastener opening in said base and a fastener receivable in said fastener opening for securement of said holding device in a fixed position alongside one of the shower walls.

7. The system of claim 3 wherein the opposite end of each said elongated support member has an opening and a stub-like projection projects from each of the bases to engage the respective openings at each of the opposite ends of each of the elongated support members.

8. The system of claim 1 wherein each said pressure transfer member includes an engagement aim extending from each side of each said pressure transfer member, one of the arms of each said pressure transfer member being engaged with the force development device and the other said arm of each said pressure transfer member being engaged with a respective one of the elongated support members.

9. The system of claim 1 wherein the force development device is adjustable and includes a threaded crank for adjusting the force that is directed by the force development device against each of the pressure transfer surfaces of each said pressure transfer member.

10. The system of claim 1 wherein the force development device and the elongated support members are detachably engaged with the pressure transfer members, and the holding devices are detachably engaged with the elongated support members.

11. The system of claim 1 wherein each said holding device includes a base and said attachment means are adapted to secure said base to a shower wall support in a position wherein said elongated support members and said holding devices are in elevated support positions corresponding to the elevated positions of the pressure transfer members when said pressure transfer members are located in the spaced elevated positions to apply pressure against a separate shower wall.

12. A system for installing shower walls comprising, a) three pressure transfer members respectively locatable in spaced elevated positions on three shower walls, each said pressure transfer member having two side portions and a base, the side portions extending away from the base, the base having a planar pressure transfer surface for applying pressure against a separate shower wall to urge the shower wall against a shower wall support, b) two adjustable force development devices for directing developed forces simultaneously through the respective said pressure transfer surfaces against separate shower walls, one said force development device being engaged with one said side portion of one said pressure transfer member and the other said force development device being engaged with the other said side portion of the one said pressure transfer member, the one said force development device being further engaged with one said side portion of a second of the pressure transfer members, and the other said force development device being further engaged with the one said side portion of a third of the pressure transfer members, c) two elongated support members having opposite ends, one end of one said elongated support member being engaged with the other said side portion of the second pressure transfer member and one end of the other said elongated support member being engaged with the other said side portion of the third pressure transfer member, and the opposite end of each said elongated support member being supportable in a fixed position, d) a pair of holding devices respectively engaged with the opposite supportable end of each said elongated support member to hold said opposite supportable ends in respective fixed positions, each said holding device having attachment means for securing the holding device to a shower wall support in the respective fixed positions and each said holding device including means for moving the shower wall in a predetermined direction.

13. The system of claim 12 wherein said moving means include a rotatable cam and a cam follower for engaging an end of a shower wall to urge the shower wall to move or slide in response to rotation of the cam with respect to the cam follower.

14. The system of claim 13 wherein the rotatable cam includes a base and a cam head pivotable with respect to the base, the cam head having a cam surface and a lever arm joined to the cam head, the cam follower having a cam engagement surface engageable with the cam surface.

15. The system of claim 14 wherein the cam follower is connected to the base by flexible connection means that permit relative movement of cam follower and the cam head toward and away from each other.

16. The system of claim 15 wherein said flexible connection means include a flexible strap member.

17. The system of claim 14 wherein said attachment means include a fastener opening in said base and a fastener receivable in said fastener opening for securement of said holding device in a fixed position alongside one of the shower walls.

18. The system of claim 14 wherein the opposite end of each said elongated support member has an opening and a stub-like projection projects from each of the bases to engage the respective openings at each of the opposite ends of each of the elongated support members.

19. The system of claim 12 wherein each said pressure transfer member includes an engagement arm extending from each side of each said pressure transfer member, one of the engagement arms of said one pressure transfer member is engaged with the one force development device and the other engagement arm of the one pressure transfer member is engaged with the other force development device, and said one engagement arm of the second and third pressure transfer members is respectively engaged with the one and the other force development devices, and the other engagement arm of the second and third pressure transfer members is respectively engaged with the one and the other elongated support members.

20. The system of claim 12 wherein each of the force development devices are adjustable and include a threaded crank for adjusting the force directed by the force development devices against each of the pressure transfer surfaces of each said pressure transfer member.

21. The system of claim 12 wherein the force development devices and the elongated support members are detachably engaged with the pressure transfer members, and the holding devices are detachably engaged with the elongated support members.

22. The system of claim 12 wherein each said holding device includes a base and said attachment means are adapted to secure said base to a shower wall support in a position wherein said elongated support members and said holding devices are in elevated support positions corresponding to the elevated positions of the pressure transfer members when said pressure transfer members are located in the spaced elevated positions to apply pressure against a separate shower wall.

* * * * *